United States Patent [19]

Halopoff

[11] 4,437,692

[45] Mar. 20, 1984

[54] PROTECTIVE HASP FOR PADLOCK

[75] Inventor: David Halopoff, Los Angeles, Calif.

[73] Assignee: Holmes-Hally Industries, Los Angeles, Calif.

[21] Appl. No.: 329,240

[22] Filed: Dec. 10, 1981

Related U.S. Application Data

[63] Continuation-in-part of Ser. No. 158,827, Jun. 12, 1980, abandoned.

[51] Int. Cl.[3] ..... E05C 5/02

[52] U.S. Cl. ..... 292/57

[58] Field of Search ..... 292/57, 150, 148; 70/134, 92, 118, 128, 129, 56

[56] References Cited

U.S. PATENT DOCUMENTS

| | | | |
|---|---|---|---|
| 875,087 | 12/1907 | Mackintosh | 292/57 |
| 1,654,913 | 1/1928 | Beemer | 292/57 |
| 2,403,065 | 7/1946 | Engert | 292/340 X |
| 3,953,062 | 4/1976 | Maston | 292/57 |
| 4,031,719 | 6/1977 | Klingler et al. | 292/57 X |
| 4,068,505 | 1/1978 | Volk, Jr. | 292/148 X |
| 4,229,956 | 10/1980 | Thorburn | 292/150 X |

*Primary Examiner*—Richard E. Moore

*Attorney, Agent, or Firm*—Beehler, Pavitt, Siegemund, Jagger & Martella

[57] ABSTRACT

A back plate serving as a slide bolt frame is designed to be fastened to a door such as a garage door to position a latch bolt slidably mounted on pivot tabs of the back plate. A cover plate has complementary pivot tabs which engage the latch bolt and pivotally mount the cover plate on the back plate. Both plates are also provided with a pair of locking tabs positioned so that one tab of each pair lies adjacent one tab of the other pair for engagement by the shackle of a padlock. In this way, the cover plate is held in an overlying position protecting the padlock. A transverse projection on the latch bolt has a slot engageable with tabs of each pair thereby to lock the latch bolt in either extended or withdrawn position.

6 Claims, 3 Drawing Figures

Fig. 1.
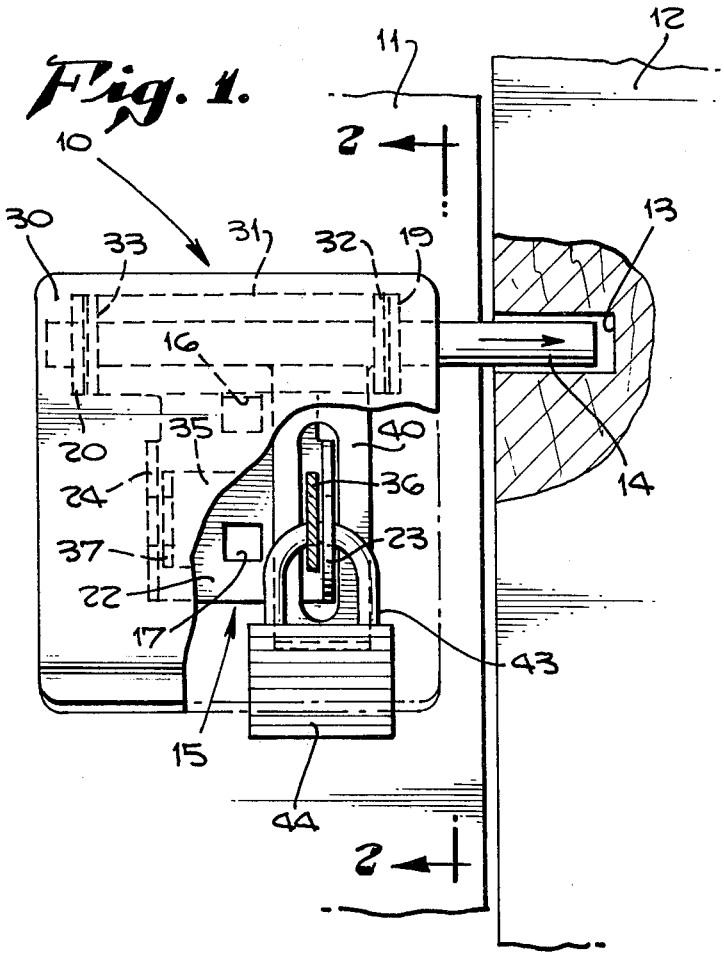
Fig. 2.
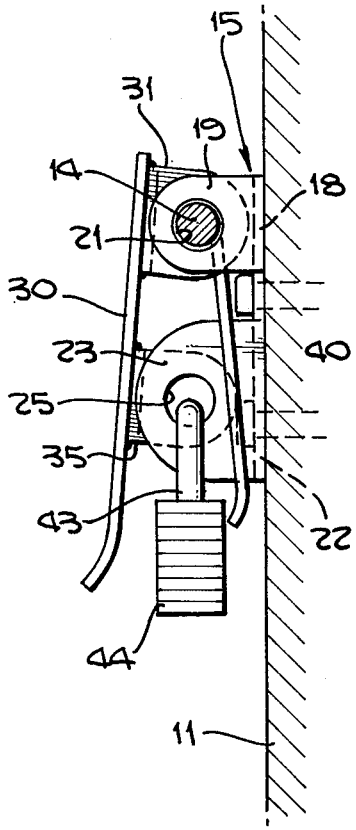
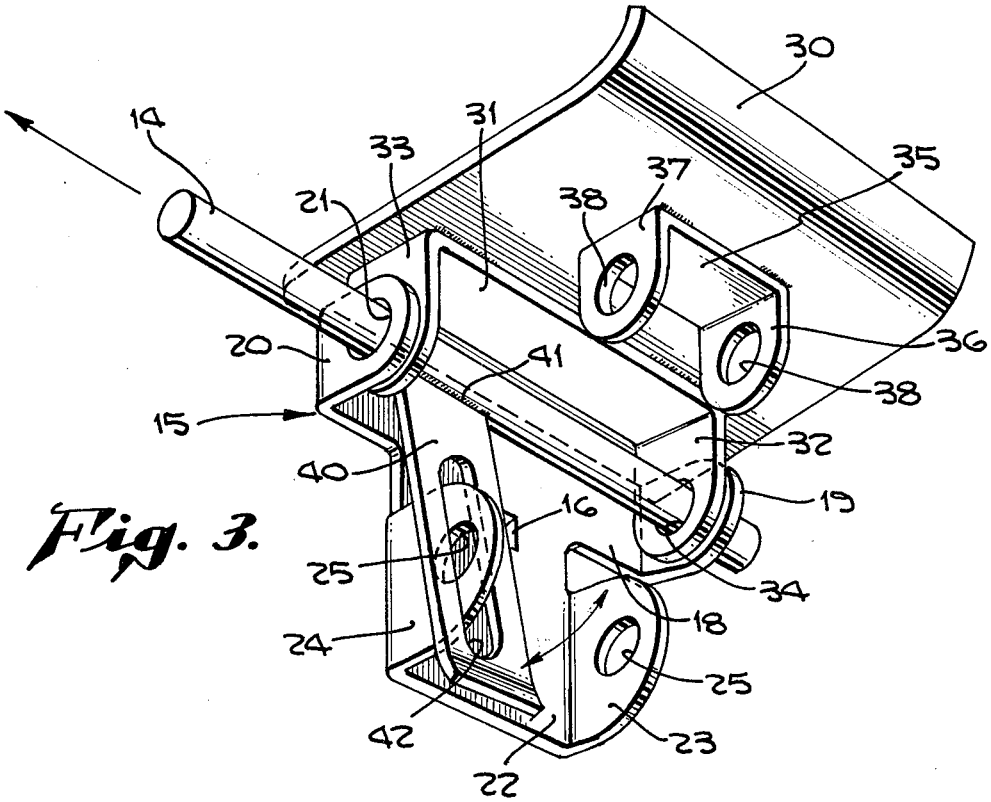
Fig. 3.

PROTECTIVE HASP FOR PADLOCK

This is a continuation-in-part of copending application Ser. No. 158,827, filed June 12, 1980 now abandoned.

Conventional hasps which have long been used for doors such as garage doors and storage warehouses, although adequate for holding the door in locked position, have had the disadvantage of leaving the padlock exposed. In recent years there has been such a marked increase in break-ins as to warrant greater attention to the security of devices of such nature. With sophisticated tools such as cable cutters, the conventional shackle of a padlock can be cut through by an unauthorized person when the shackle is exposed to a sufficient degree to be reached by the cutting tool. A sharp heavy blow on the body may also spring the lock. These circumstances have prompted various innovations to afford greater protection for locking devices such as the conventional padlock.

Various types of shields have been resorted to for covering the entire installation. On other occasions somewhat elaborate body structures have been evolved for reception not only of the padlock shackle but the body of the padlock itself, leaving no more than the keyway exposed. Although security can be built into a padlock type installation, many security features overlook the fact that hasps, of the kind made reference to, are not fundamentally a high security installation such as might be the installation of an entirely different type of security lock set. As a result, some of the expedients proposed involve a complex structure, the expense of which is not warranted for hardware of such nature. In addition to unwarranted increase in expense, such installations have been of the sort frequently difficult to install and time-consuming for the user to manipulate.

It is therefore among the objects of the invention to provide a new and improved protective hasp for a padlock which is relatively conventional in its overall design, rugged in its construction, and of a type sufficiently simple to be within the price range for hardware of such nature.

Another object of the invention is to provide a new and improved protective hasp for padlocks which by resort to a relatively simple protective plate arrangement, is one capable of so concealing the padlock that it cannot readily be reached with cutters normally available to unauthorized persons.

Still another object of the invention is to provide a new and improved protective hasp for padlocks which, though affording ample coverage and protection for both the padlock and is shackle, still keeps the padlock reasonably well available to the user.

Still another object of the invention is to provide a new and improved protective hasp for padlocks which is secure and rugged construction, built in a fashion to permit ready installation and of such construction that although keeping the padlock itself readily available, covers the installation sufficiently well to defeat most attempts at unauthorized entry.

With these and other objects in view, the invention consists of the construction, arrangement, and the combination of the various parts of the device serving as an example only of one or more embodiments of the invention, whereby the objects contemplated are attained, as hereinafter disclosed in the specification and drawings, and pointed out in the appended claims.

In the drawings:

FIG. 1 is a front elevational view showing the protective hasp in position on a door, partly broken away to reveal a padlock.

FIG. 2 is a side elevational view on the line 2—2 of FIG. 1.

FIG. 3 is a perspective view of the protective hasp with the cover lifted to reveal the portions normally concealed.

In an embodiment of the invention chosen for the purpose of illustration, the protective hasp indicated generally by the reference character 10 is shown mounted on a swinging door 11 which fits within a frame 12. In the frame is a hole 13 adapted to receive a latch bolt 14 extending from the protective hasp.

The protective hasp consists of a back plate 15 serving as a slide bolt frame in which there are square openings 16 and 17. The square openings are adapted to receive conventional carriage bolts (not shown) by means of which the back plate may be anchored to the door 11. The back plate consists of a relatively wider portion 18 at the opposite ends of which are pivot tabs 19 and 20. In the pivot tabs are openings 21 for reception of the latch bolt 14. On a relatively narrower portion 22 of the back plate are outwardly bent locking tabs 23 and 24 which are provided with holes 25.

In cooperation with the back plate 15 is a cover plate assembly featuring in the main a cover plate 30. On the inner face of the cover plate is a bracket 31 which supports at its opposite ends respective pivot tabs 32 and 33. These tabs are provided with axially aligned openings 34 which also align themselves operatively with the openings 21. The latch bolt 14, previously made reference to, extends through the openings 21 and 34 in a slidable fashion, and by that means provides a pivotal connection between the back plate 15 and the cover plate 30.

Spaced from the bracket 31, as viewed in FIG. 3, is a second bracket 35 which supports at its opposite ends respective locking tabs 36 and 37. These tabs are provided with axially aligned holes 38. The tabs 36 and 37 are located relatively closer together than the pivot tabs 32 and 33, for example, as are also the locking tabs 23 and 24.

To complete the assembly a relatively flat projection 40 is anchored by appropriate means such, for example, as welding 41, so that the latch bolt and its projection act as a single composite piece. In the projection 40 is a slot 42 long enough and wide enough to be applied comfortably over one or another of the locking tabs 23 or 24. In the embodiment of the invention here under consideration, when the latch bolt 14 is extended to lock position, as shown in FIG. 1, within the hole 13, the projection 40 and its slot 42 are in alignment with the locking tab 23. This is the position where the latch bolt is extended into the hole 13 in locked position of the device. Instead of there being supplied an extra piece to form the projection 40, the latch bolt itself may be reversely bent in a loop (not shown) at the same location so that the loop becomes the slotted projection.

What may be termed the thrust distance of the latch bolt between withdrawn and extended position is substantially the same as the distance between the sets of adjacent locking tabs. The thrust is effective for either a right-hand or left-hand mounting on the door.

With the projection applied over the locking tab 23, the cover 30 is lowered to the point where the locking tab 36 substantially coincides with locking tab 23, with the respective holes 25 and 38 in alignment. A shackle 43 of a conventional padlock is then projected through the axially aligned holes 25 and 38 and there locked in place, as shown in FIG. 1.

In locked position of the padlock operating parts exemplified by the shackle 43 and body 44 are at a location where they are substantially concealed beneath the cover plate 30. This same locking together of the locking tabs serves to anchor the cover 30 in position overlying the padlock. With the padlock shackle protected as shown by the cover plate, insufficient room remains for insertion of a conventional cutting tool which might be used to cut the shackle. By the same precautionary structure, the cover plate is held so close to the body of the padlock that the body cannot readily be struck with a heavy tool a sufficient blow to dislodge the shackle from the body. Moreover, in this position, locking of the projection 40 in engagement with the locking tab 23 prevents the latch bolt 14 from being withdrawn from the hole 13.

When it becomes desirable to unlock the protective hasp, a key can readily be inserted in a key slot in the bottom face of the padlock thereby to disengage the shackle 43 so that it can be withdrawn from the respective holes 25 and 38.

For convenience, the latch bolt 14 can be locked in withdrawn or unlocked position. This is accomplished by applying the slot 42 of the projection 40 over the locking tab 24 with the latch bolt 14 withdrawn. If desired, the cover can again be lowered into a position where the locking tab 37 and locking tab 24 can be locked together by inserting the shackle 43 of the padlock 44 into the respective holes 25 and 38. In this position also the shackle and body of the latch bolt is protected by the cover plate.

Two padlocks may be employed simultaneously, one with the shackle extending through the holes of the set of locking tabs 23 and 36, the other extending through the holes in the set of locking tabs 24 and 37. Both padlocks in locked position will be protected by the same cover plate 30. As can readily be observed from an examination of FIG. 1, the width and length of the back plate 15 is appreciably less than the width and length of the front plate 30 thereby assuring abundant simultaneous covering for all of the operating parts.

While a particular embodiment of the present invention has been shown and described, it will be obvious to those skilled in the art that changes and modifications may be made without departing from the invention in its broader aspects, and therefore, the aims of its appended claims is to cover all such changes and modifications as fall within the true spirit and scope of the invention.

Having described the invention, what is claimed as new in support of Letters Patent is as follows:

1. A protective hasp for a padlock and its shackle comprising a back plate having fastening means therein, a cover plate spaced from the back plate when in a closed position and forming a space therebetween, and a pair of laterally spaced pivot tabs having captive ends on adjacent faces of each plate mounted so that the tabs of one pair lie adjacent respective tabs of the other pair forming sets of adjacent pivot tabs on respective opposite sides of the hasp with free ends of pivot tabs on one plate in close proximity to the opposite plate and within said space between the plates, axially aligned pivot holes in the pivot tabs substantially midway between opposite ends of respective tabs, and a latch bolt slidably mounted in the pivot holes whereby to pivotally assemble said plates so that adjacent faces of the respective plates face each other in locked position, said latch bolt having a slidable locking thrust between extending locked position on one side of said hasp and a withdrawn position from said side of said hasp, a pair of spaced locking tabs of substantially the same height as the pivot tabs on the adjacent face of each plate mounted so that the locking tabs of one pair lie adjacent respective locking tabs of the other pair forming laterally spaced sets of adjacent locking tabs with shackle holes in each set of locking tabs in substantial alignment, each set of locking tabs being receptive of a padlock shackle at a location spaced inwardly from side edges of the cover plate, free ends of locking tabs on one plate being in close proximity to the opposite plate when the cover plate is in locked position, said shackle holes being substantially midway between opposite ends of the respective tabs, said cover plate having one edge portion extending beyond and covering said pivot tabs, that portion of said cover plate adjacent one of said edge portions extending beyond and covering said locking tabs and adapted to cover the padlock shackle and substantially cover the padlock body when said padlock is engaged with either set of locking tabs, a transverse projection on the latch bolt intermediate opposite ends and mounted within the space between said sets of pivot tabs, said projection in respective extended and withdrawn positions of the latch bolt having a position adjacent the respective set of pivot tabs, said projection having a slot therein for reception of the sets of adjacent locking tabs whereby upon reception of the padlock shackle the latch bolt is locked in either extended or withdrawn position with the projection beneath the padlock shackle and the cover plate is simultaneously locked to the back plate in a position of protection for said padlock.

2. A protective hasp as in claim 1 wherein the locking tabs on the back plate are bent portions of the back plate at respective side edges of the back plate and the locking tabs of the cover plate are located inwardly relative to the side edges of the cover plate whereby to locate the padlock shackle beneath the cover in locked down position of the cover.

3. A protective hasp as in claim 2 wherein the distance between said sets of locking tabs is substantially equal to the locking thrust of said latch bolt.

4. A protective hasp as in claim 1 wherein the transverse breadth and vertical length of the cover plate is greater respectively than the transverse breadth and vertical length of the back plate, and wherein said projection in extended position of the latch bolt has a position adjacent the set of pivot tabs on the corresponding side of the hasp.

5. A protective hasp as in claim 1 wherein the withdrawn position of said latch bolt from said one side of the hasp is an extended locked position on the opposite side of said hasp.

6. A protective hasp as in claim 1 wherein fastening means on the back plate is at a location between said sets of locking tabs.

* * * * *